US005761322A

United States Patent [19]

Illingworth et al.

[11] Patent Number: 5,761,322

[45] Date of Patent: Jun. 2, 1998

[54] PORTABLE COMPUTER SPEAKER ENCLOSURE

[75] Inventors: Patrick V. Illingworth, Spring; David E. Gough, Houston, both of Tex.

[73] Assignee: Compaq Computer Corporation, Houston, Tex.

[21] Appl. No.: 778,412

[22] Filed: Dec. 31, 1996

[51] Int. Cl.[6] ..... H04R 1/02

[52] U.S. Cl. ..... 381/188; 181/151; 181/166; 381/205; 381/88; 381/90

[58] Field of Search ..... 381/188, 205, 381/158, 88, 90; 181/151, 166; 248/559, 636; 174/35 GC

[56] References Cited

U.S. PATENT DOCUMENTS

| | | | |
|---|---|---|---|
| 3,573,396 | 4/1971 | Schoengold . | |
| 4,660,186 | 4/1987 | Massa | 367/142 |
| 5,030,128 | 7/1991 | Herron et al. | 439/372 |
| 5,052,943 | 10/1991 | Davis | 439/357 |
| 5,265,238 | 11/1993 | Canova, Jr. et al. | 395/500 |
| 5,283,714 | 2/1994 | Tsai et al. | 361/683 |
| 5,290,178 | 3/1994 | Ma | 439/652 |
| 5,313,596 | 5/1994 | Swindler et al. | 395/281 |
| 5,323,291 | 6/1994 | Boyle et al. | 361/686 |
| 5,347,425 | 9/1994 | Herron et al. | 361/686 |
| 5,377,357 | 12/1994 | Nishigaki et al. | 395/800 |
| 5,396,400 | 3/1995 | Register et al. | 361/686 |
| 5,411,416 | 5/1995 | Balon et al. | 439/639 |
| 5,430,617 | 7/1995 | Hsu | 361/818 |
| 5,450,271 | 9/1995 | Fukushima et al. | 361/686 |
| 5,457,785 | 10/1995 | Kikinis et al. | 395/308 |
| 5,463,742 | 10/1995 | Kobayashi | 395/281 |
| 5,477,415 | 12/1995 | Mitcham et al. | 361/686 |
| 5,481,616 | 1/1996 | Freadman | 381/90 |
| 5,488,572 | 1/1996 | Belmont | 364/514 |
| 5,493,542 | 2/1996 | Odelid | 368/10 |
| 5,497,490 | 3/1996 | Harada et al. | 395/700 |
| 5,526,493 | 6/1996 | Shu | 395/281 |
| 5,535,093 | 7/1996 | Noguchi et al. | 361/686 |
| 5,640,461 | 6/1997 | Ebert et al. | 381/188 |
| 5,647,007 | 7/1997 | Wooderson et al. | 381/90 |
| 5,668,882 | 9/1997 | Hickman et al. | 381/24 |

*Primary Examiner*—Forester W. Isen
*Attorney, Agent, or Firm*—Robert Groover; Betty Formby; Matthew S. Anderson

[57] ABSTRACT

A portable computer system including sealed acoustic suspension speaker enclosures which are each molded of a high density-low-density polymer combination, so that the low-density polymer can provide good sealing to adjacent surfaces. Preferably, neither speaker enclosure is sealed as a free standing unit, but the acoustic seal is completed only when the speaker enclosure is in place inside the portable computer.

10 Claims, 4 Drawing Sheets

PORTABLE COMPUTER SPEAKER ENCLOSURE

BACKGROUND AND SUMMARY OF THE INVENTION

This application concerns portable multimedia computer systems, and more particularly concerns compact audio speaker systems for a portable computer.

1. Background: Speaker Enclosures

One of the basic problems of acoustic speakers is that acoustic radiation from the backside of the moving part of the speaker can be out of phase with radiation from the front side of the speaker. This means that at wavelengths which are long in relation to the physical dimension of the speaker, the emission from the backside of the speaker will tend to cancel the emission from the front side of the speaker. This in turn means that any freestanding speaker will see a very low acoustic impedance at wavelengths which are long in relation to its physical size, and therefore will not tend to couple acoustic power efficiently into the air.

One of the basic approaches to this impedance problem is to use an acoustic suspension speaker, wherein the driver is sealed into a box. The box suppresses radiation of acoustic energy from the backside of the driver diaphragm. Such a closed box will also provide some stiffening for the diaphragm movement, and may also be used to provide a damping (resistive) load to the moving diaphragm. A modification of acoustic suspension speakers is ported speakers, in which a port couples out energy from the cavity. Due to the reactance of the port, the resulting phase shift will not produce the same immediate cancellation at low frequencies as a freestanding speaker would tend to produce. Moreover, the port and cavity define a Helmholtz resonator, and the resonant frequency of this resonator can be selected to provide some low frequency enhancement at the lowest frequencies expected for use.

Thus in any conventional speaker system, it is desirable to provide a sealed air-volume at the backside of the driver. This is particularly important when the speaker itself covers a small area.

In a portable computer system, of course, there is very little volume available to any one component, so it is particularly important to balance the requirements of satisfactory audio reproduction and the need to keep the sound system as small as possible within the computer system.

In conventional portable computer systems, small speakers have typically been mounted directly to either the body of the system or to the flip-up display of the system, and no sealed air chamber has been provided to allow the sound to resonate as it is being produced.

The acoustics of speaker design have been fairly well understood for some years now. See generally Colloms, *High Performance Loudspeakers* (Halsted Press, 2nd ed. 1980), and Langford-Smith, *Radiotron Designer's Handbook* (Radio Corporation of America, 1954), which are hereby incorporated by reference. However, this area of engineering has not been expensively applied to the design of multi-media portable computer systems.

2. Background: Multi-Media Portable Computers

Multi-media portable computer systems must normally include, in addition to the normal output devices (display and possibly a printer connection), acoustic output from speakers. (In addition, multi-media computers normally also include a microphone for audio input.) The standards for multi-media computers were defined in relation to desk top computers, and do not directly take account of the format of portable computers. In particular, it is very difficult to implement speakers in a small portable computer.

In portable computers, volume and weight are both very much at a premium. In particular, surface area of the computers exterior is also at a premium. As portable devices, portable computers can be expected to receive fairly rough usage. Therefore, it is desirable that the speakers be located in some area which is at least partially protected when the computer is closed. Thus in some portable computers, the speakers have been located so that they vent into the surface which is covered when the computer is closed, but is exposed when the computer is open to expose the display.

The speakers which have been used in portable computers have typically used solenoidal drivers which are simply mounted to an opening in the display cover of the computer. The problem is that such speakers have tended to produced an unpleasantly distorted sound. The present invention provides portable computers with greatly improved sound quality.

Innovative Multimedia Portable Computer System

The innovative system provides for small speaker modules which fit conformally into an extremely limited space (within the display body of a portable computer, in the presently preferred embodiment). The speaker enclosures are formed by a two-stage molding process, which produces an integral layer of very soft material along the sealing edge of the enclosure. Thus this integral layer of very soft material acts as an integral "gasketing" layer, which reduces the need for a separate gasketing material to be used during assembly of the speaker modules into their desired location.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment (by way of example, and not of limitation), in which:

A first embodiment is one in which the speaker is mounted in an enclosure which is formed by a two step molding process and forms a structure that is open on one side and can be mounted flush against the interior side of the wall of the display enclosure of the portable system.

In this way, the display enclosure itself forms a seal with the existing chamber edges and thereby completes the enclosure. This embodiment recognizes that it is necessary to provide a chamber and display wall that closely match each other conformally so that the air-volume is sealed within the chamber.

Another embodiment provides that in a one stage process the majority of the chamber is formed, but instead of sealing the final side with the wall of the portable display enclosure itself, a mylar film is sealed over the open end, thereby providing the final wall and sealing the speaker enclosure. This would provide for a stand alone speaker enclosure which may be utilized in a wide range of portable systems, without having to provide that the display itself closely matches the contours of the speaker enclosure. As such, the speaker and enclosure could simply be installed into whichever system required it, and could be readily replaced when necessary.

In another embodiment, a portion of one edge of the speaker enclosure is left open as formed so that the side wall of the display case forms the final barrier. A characteristic of other embodiments is that there must be both a chamber wall and the wall of the portable computer's display, usually abutting each other. By using the existing wall of the display as a chamber wall, the volume available for the chamber and the speaker itself is maximized, since it is no longer necessary to sacrifice the space required for the redundant chamber wall.

Figure 1:
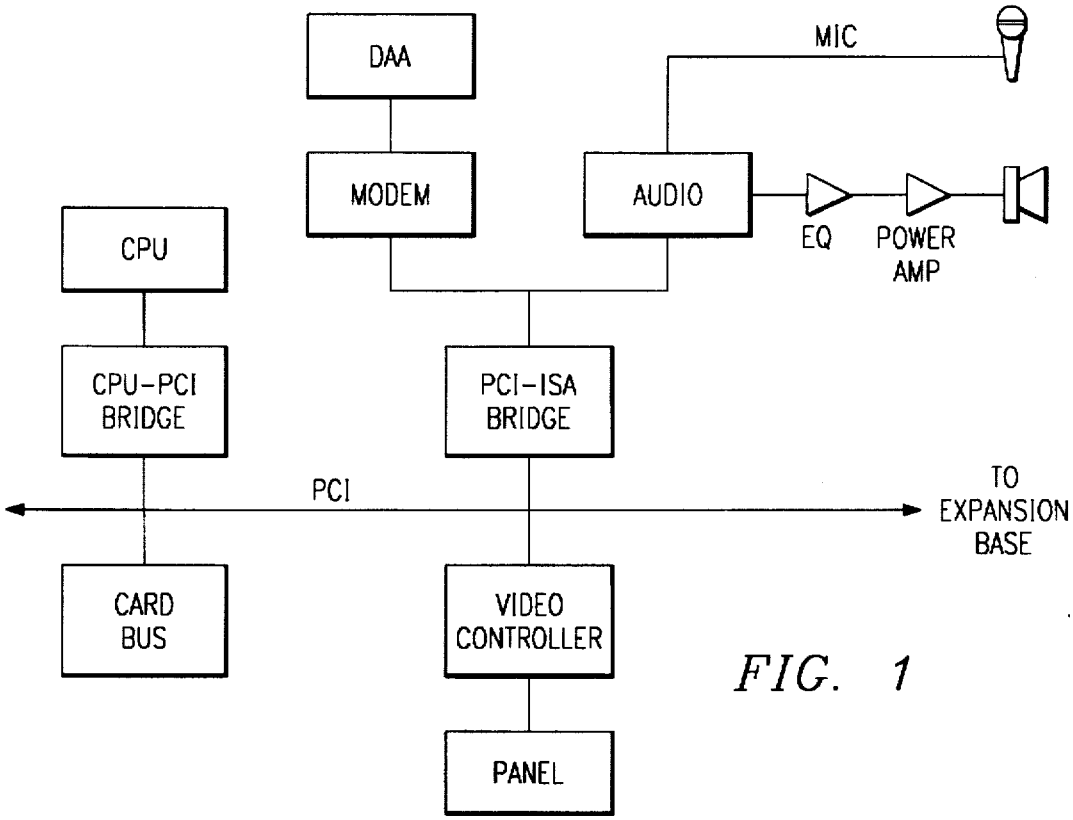
FIG. 1 shows a high-level diagram of a typical multimedia computer system.

FIG. 1 shows a high-level diagram of a typical multimedia computer system. The CPU, which as of the filing date would typically be an Intel Pentium processor, is connected to a PCI bus via a CPU-PCI bridge. A card bus is also connected to the PCI bus. A display panel is connected to the PCI bus via a video controller. The PCI bus may also connect to an expansion base.

A PCI-ISA bridge connects the PCI bus to additional peripheral equipment, including a modem and an audio system. The audio system includes a microphone for audio input, and an equalizer, power amp, and speaker system for audio output.

Figure 2:
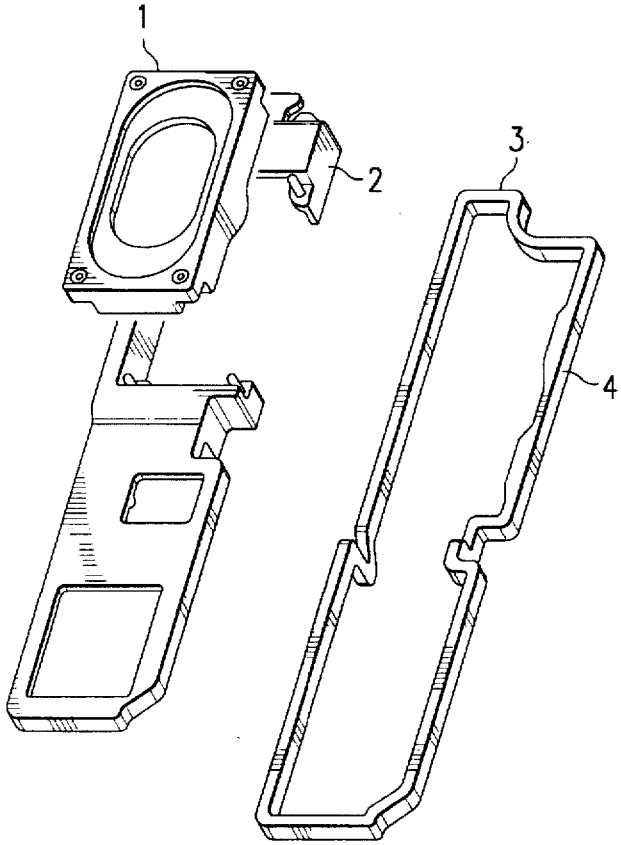
FIG. 2 shows a right-side speaker assembly according to the presently preferred embodiment.
Figure 3:
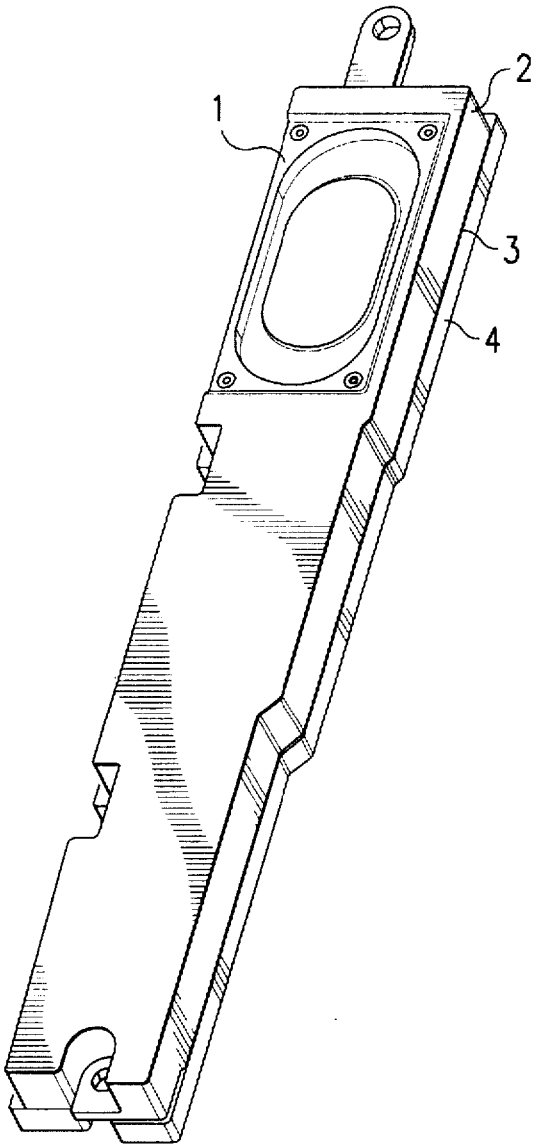
FIG. 3 shows an assembled view of a left-side speaker assembly according to another preferred embodiment.

FIG. 2 shows an exploded view of a speaker assembly according to one presently preferred embodiment. Speaker 1 fits within and is securely attached to the chamber lid 2. Chamber lid 2 is then mated with chamber 4 to form the speaker enclosure. The entire assembly forms an airtight chamber. FIG. 3 shows an assembled view of a speaker assembly according to another presently preferred embodiment.

In the preferred embodiment, chamber lid 2 and chamber 4 are formed of a hard resin. As of the effective filing date of this application, the preferred hard resin is GE Cycolac™ SEA-2.

To seal the enclosure, a gasketing layer 3 is formed along the top edge of the chamber, which seals the chamber to the chamber lid when the speaker enclosure is assembled. FIG. 2 shows the gasketing layer 3 as formed on the sealing edge of the chamber 4, and FIG. 3 shows the gasketing layer 3 sealing the speaker enclosure where the chamber 4 and the chamber lit 2 are joined.

In the preferred embodiment, the gasketing layer is integrally formed with the chamber in a two-step molding process. In this embodiment, the gasketing layer is formed of a very soft resin, which as of the effective filing date is Thermolast-™ TC-2AAA, manufactured by the German supplier Kraton, and a chemical bond is formed between the hard and soft resin layers. In the preferred embodiment, the gasketing layer is 3 mm thick.

In alternate embodiments, the gasketing layer is formed on other joining surfaces of the speaker assembly, e.g. on the surface of chamber lid 2 where it seals with chamber 4, or on either surface where the speaker 1 is joined with chamber lid 2.

In the preferred embodiment, the left-side speaker and the right-side speaker are asymmetrical. Thus FIG. 2 shows an exploded view of a right-side speaker assembly, and FIG. 3 shows an assembled view of a left-side speaker assembly, in one sample embodiment.

Figure 4:
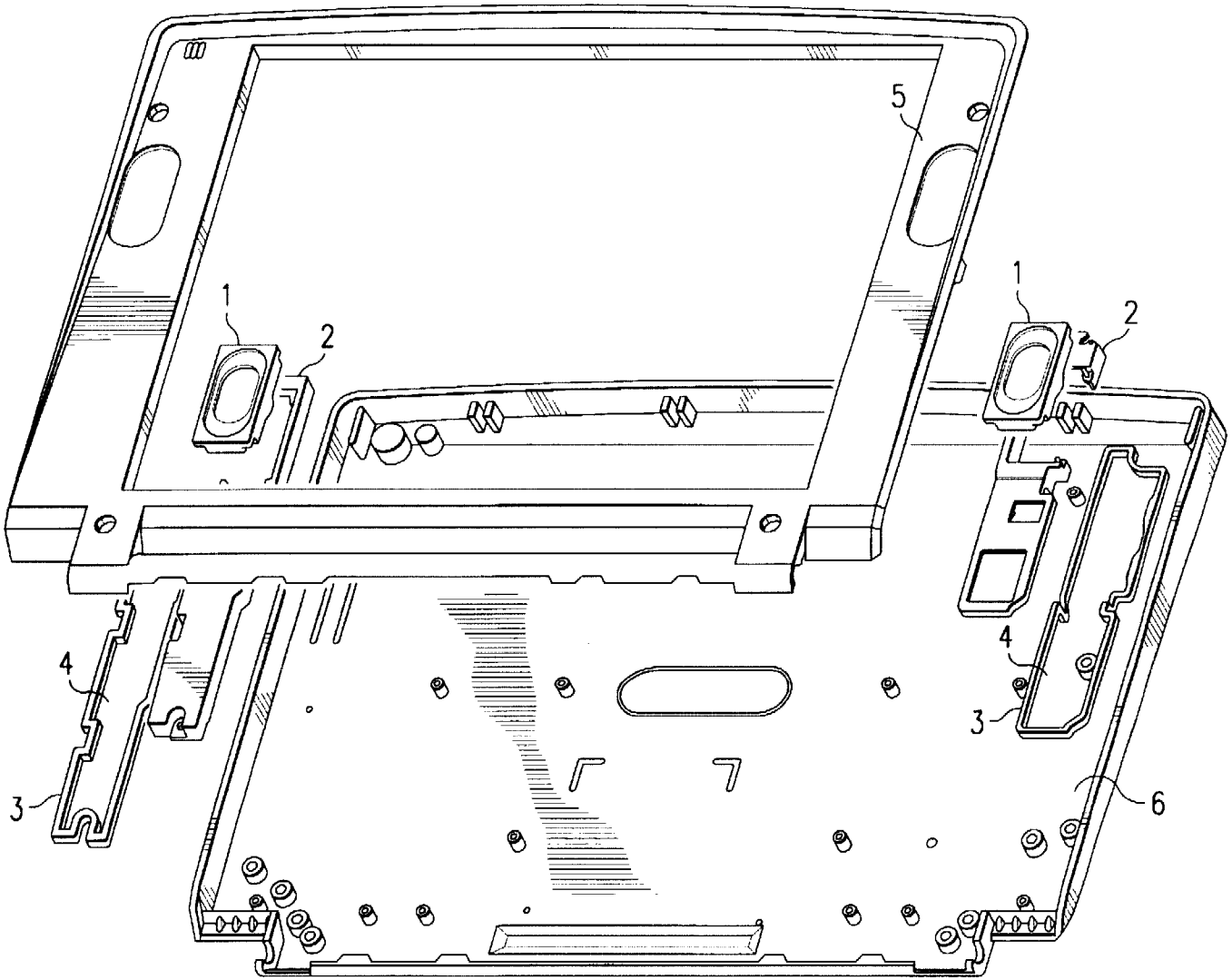
FIG. 4 shows an exploded view of a speaker assembly and display enclosure.

FIG. 4 shows an exploded view of a pair of speaker assemblies and a display enclosure, in one sample embodiment. Display cover 5 and display back 6 form the display enclosure in which the speaker assembly is housed.

Figure 5:
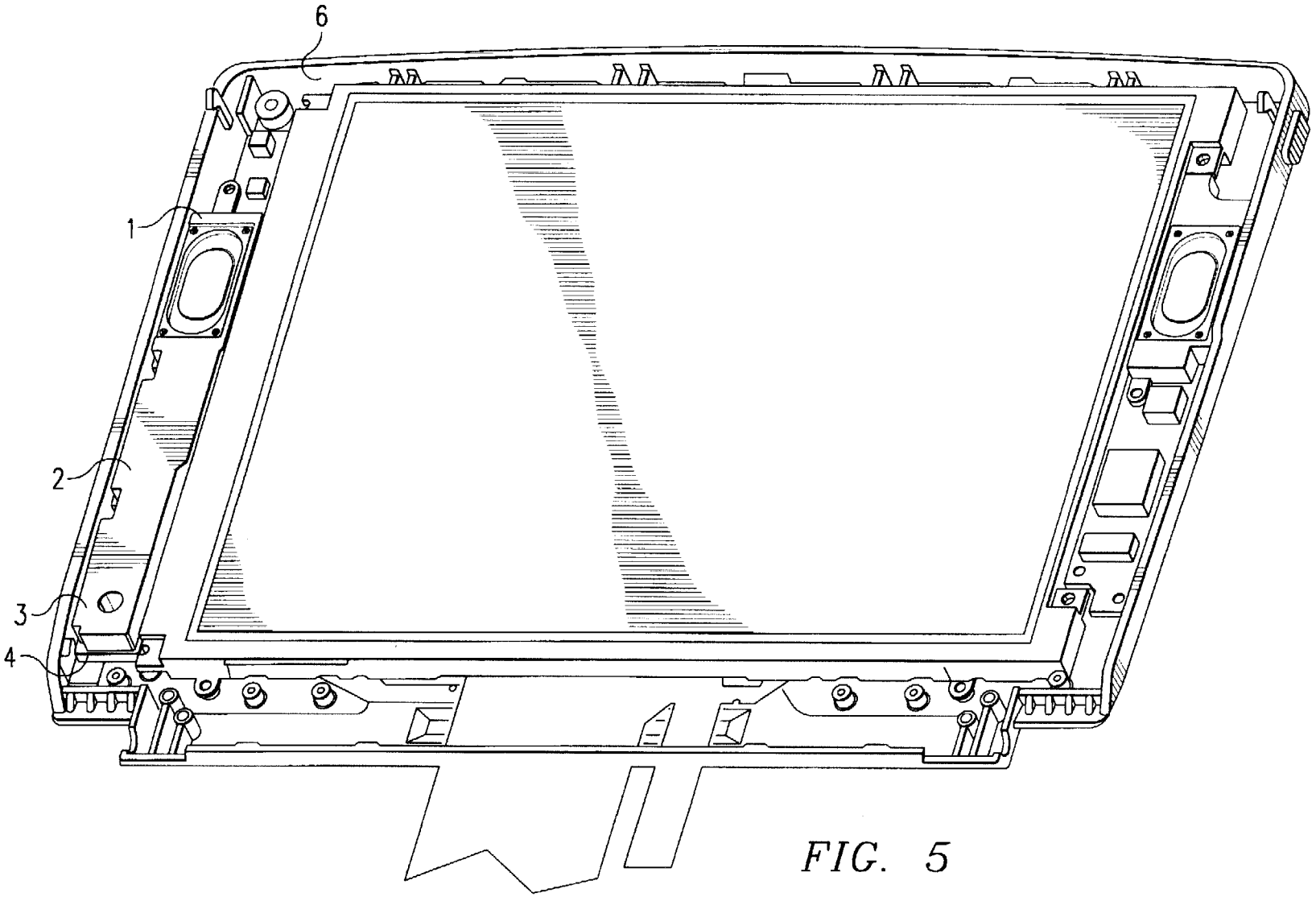
FIG. 5 shows an assembled view of a speaker assembly and display enclosure according to the presently preferred embodiment, with a top surface cut away.

FIG. 5 shows an assembled view of a speaker assembly and display enclosure according to the presently preferred embodiment, with display cover 5 removed. Note that one of the speaker enclosures has a shape which is slightly different, in this embodiment, from that in FIG. 4.

In the preferred embodiment, the speaker assemblies each form a self-contained, sealed unit. In other embodiments, the speaker assembly may employ one or more of the display enclosure walls to form the sealed chamber. Preferably, in these embodiments a gasketing layer of used to seal the joints of the speaker assembly and the display wall.

According to one disclosed class of innovative embodiments, there is provided a computer system, comprising: a housing, containing therein memory and at least one programmable processor; one or more drivers, operatively connected to receive audio signals defined by said processor and to emit acoustic energy accordingly; wherein each said driver has a back side which is surrounded by a respective individual acoustic enclosure, and has a front side connected to emit acoustic energy through an external surface of said enclosure; and wherein each said individual acoustic enclosure has a first portion of a first molded polymer composition which provides a sealing surface which is at least partly parallel to said driver, and also has a second portion of polymer of a higher durometer rating than said first molded polymer composition which provides acoustic enclosure around said driver.

According to another disclosed class of innovative embodiments, there is provided a speaker module, comprising: a rigid enclosure, predominantly formed of a first polymer material, and having therein at least one aperture; an electroacoustic speaker element mounted to said rigid enclosure; soft gasketing material, formed of a second polymer material which is much softer than said first material, bordering said aperture in said rigid enclosure; said soft gasketing material being formed integrally with said first material, and chemically bonded thereto without any intervening adhesive material.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

It should be noted that the disclosed innovations are not at all limited to the specific portable computer configuration of the presently preferred embodiment. For example, it is not necessary that this be applied only to the hinged folding housing configuration which is the most common as of 1996. This can also be directly adapted to computer configurations which include multiply hinged connections, or removable keyboard and/or display sub-modules, or other such modified configurations.

It is also not necessary for the speakers to be housed in the display portion of the housing. As displays become larger, less and less volume is available in the display portion of the computer.

A particular advantage of the disclosed speakers units is that they are module assemblies which can be rapidly assembled into a portable computer. Moreover, the modules can be reused in subsequent generations of computers, as long as those generations have a somewhat similar physical configuration.

It should be noted that the disclosed innovations are also applicable to embodiments in which only a single speaker is used, and to embodiments in which more than two speakers are used.

It should also be noted that at least some of the disclosed innovations can be applied to ported systems as well as to pure acoustic-suspension systems. Moreover, in such a ported system, the port may be vented into the interior of the computer enclosure rather than to the exterior.

It should also be noted that the speakers and their enclosures may be located in the body of the portable computer system or the same innovative techniques could be used for stand-alone speakers. Further, the disclosed innovative speakers and enclosures may be employed in combination with a microphone system. In such embodiments the microphone system is decoupled from the speaker system as much as possible, to allow applications such as a full duplex speakerphone.

Moreover, the innovative speaker enclosures can be used in environments other than computer systems. While use in portable computer systems is preferred and most advantageous, the disclosed inventions may also be useful in other environments where great compactness is needed. Some other application areas include portable personal electronic music players, automobiles, etc.

It should also be noted that the disclosed innovative ideas are not by any means limited to systems using a single-processor CPU, but can also be implemented in computers using multiprocessor architectures.

What is claimed is:

1. A computer system, comprising:

a housing, containing therein memory and at least one programmable processor;

one or more drivers, operatively connected to receive audio signals defined by said processor and to emit acoustic energy accordingly;

wherein each said driver has a back side which is surrounded by a respective individual acoustic enclosure, and has a front side connected to emit acoustic energy through an external surface of said enclosure;

and wherein each said individual acoustic enclosure has a first portion of a first molded polymer composition which provides a sealing surface which is at least partly parallel to said driver, and also has a second portion of polymer of a higher durometer rating than said first molded polymer composition which provides acoustic enclosure around said driver, said first and second portions being integral and chemically bonded to each other without any intervening adhesive material.

2. The system of claim 1, wherein at least one said individual acoustic enclosure is shaped to be acoustically closed by adjacent surfaces of said housing.

3. The system of claim 1, wherein said drivers are solenoidal drivers.

4. The system of claim 1, wherein said housing is a two piece housing having a hinge which connects a display portion to a main portion, and wherein said drivers are both located in said display portion.

5. The system of claim 1, wherein said housing includes a keyboard therein.

6. The system of claim 1, wherein said housing includes a drive for a removable data medium having formatted capacity of at least 500 megabytes.

7. The system of claim 1, wherein said drivers are operatively connected to said processor through an audio amplifier.

8. A speaker module, comprising:

a rigid enclosure, predominantly formed of a first polymer material, and having therein at least one aperture;

an electroacoustic speaker element mounted to said rigid enclosure;

soft gasketing material, formed of a second polymer material which is much softer than said first material, bordering said aperture in said rigid enclosure; said soft gasketing material being formed integrally with said first material, and chemically bonded thereto without any intervening adhesive material.

9. The module of claim 8, wherein said rigid enclosure is shaped to be acoustically closed by adjacent surfaces of a computer housing.

10. The module of claim 8, wherein said speaker elements are solenoidal drivers.

* * * * *